United States Patent [19]

Kawashima et al.

[11] 4,202,182

[45] May 13, 1980

[54] MULTI-TUBE EVAPORATOR FOR A COOLER USED IN AN AUTOMOBILE

[75] Inventors: Kenichi Kawashima, Hitachi; Yosiaki Arima, Taga; Yoshihide Endo, Katsuta; Atsushi Suginuma; Akira Uenishi, both of Mito; Seigo Miyamoto, Takahagi, all of Japan

[73] Assignee: Hitachi, Ltd., Japan

[21] Appl. No.: 902,497

[22] Filed: May 3, 1978

[30] Foreign Application Priority Data

May 10, 1977 [JP] Japan ..... 52-53473

[51] Int. Cl.[2] ..... F25B 41/06

[52] U.S. Cl. ..... 62/511; 62/527; 138/42; 165/174

[58] Field of Search ..... 62/511, 515, 527; 165/174; 138/40, 42; 228/131, 132, 249, 253

[56] References Cited

U.S. PATENT DOCUMENTS

| | | | |
|---|---|---|---|
| 2,318,206 | 5/1943 | Eisenlohr | 138/42 |
| 2,373,116 | 4/1945 | Hobrock | 228/131 |
| 2,597,744 | 5/1952 | Morrison | 165/180 |
| 2,707,868 | 5/1959 | Goodman | 62/511 |
| 3,153,429 | 10/1964 | Palm | 165/174 |
| 3,512,356 | 5/1970 | Krekeler | 228/249 |
| 3,566,615 | 3/1971 | Roeder, Jr. | 62/511 |
| 3,864,938 | 2/1975 | Hayes, Jr. | 62/511 |

*Primary Examiner*—Ronald C. Capossela
*Attorney, Agent, or Firm*—Craig and Antonelli

[57] ABSTRACT

A multi-tube evaporator for a cooler used in an automobile is provided with a columnar member tightly inserted in the evaporating tube at its inlet. A spiral groove is engraved on the surface of the columnar member. The spiral groove serves as a capillary through which refrigerant is expanded.

5 Claims, 4 Drawing Figures

MULTI-TUBE EVAPORATOR FOR A COOLER USED IN AN AUTOMOBILE

BACKGROUND OF THE INVENTION

This invention relates to a structure of a multi-tube evaporator, especially to a structure of a capillary arranged between a refrigerant supply header and each of the evaporating tubes of a multi-tube evaporator for a cooler used in an automobile.

In a cooling system of a cooler used in an automobile, gaseous refrigerant is discharged from a compressor at high pressure and fed into a condenser. The gaseous refrigerant is condensed into liquid refrigerant in the condenser. The liquid refrigerant is forced to pass through the expansion means of refrigerant and fed into an evaporator. The pressure of the liquid refrigerant is reduced by the capillary. While the liquid refrigerant changes into the gaseous refrigerant in the evaporating tubes of the evaporator, the refrigerant takes evaporation heat away from the surroundings of the evaporator. The gaseous refrigerant is discharged from the evaporator and is back to the compressor.

In such a cooling system, it is desirable to attain an uniform distribution of the liquid refrigerant throughout the whole evaporating tubes of the evaporator. The uniform distribution of the liquid refrigerant causes highly efficient operation of the evaporator.

U.S. Pat. No. 2,707,868 discloses that capillaries had previously been unsuccessfully in an attempt to produce equal distribution of refrigerent to each of a plurality of evaporator tubes and teaches the use of metering orifices disposed at each entrance for the liquid refrigerant into the evaporating tubes. The refrigerant is fed to the orifices or restrictions at relatively high pressure. The flow of the refrigerant into the respective tubes is accurately governed and uniform distribution of the refrigerant is attained. However, U.S. Pat. No. 2,707,868 does not disclose the specific structure of the unsuccessful capillaries.

The diameter of a capillary depends upon the dimensions of the evaporating tubes, and the dimensions of the evaporating tubes depend upon the load of the evaporator. For example, if the evaporating tube has 6.8 millimeters in its diameter and has 1.8 meters in its length, then the capillary is desirable to have about 1 millimeter in its diameter and have 80 to 130 millimeters in its length. The use of a fine tube as a capillary is proposed in a U.S. patent application Ser. No. 692,760 ("COMPRESSION TYPE REFRIGERATION APPARATUS FOR AUTOMOBILES" in the name of Kawashima et al., filed on June 4, 1976 abandoned). However, the fine tube has following defects. (1) A spiral fine tube used as a capillary is difficult to manufacture. (2) One end of the spiral capillary tube opens in the evaporating tube and the other end opens in the refrigerant supply header in which all evaporating tubes open. The spiral capillary tube is supported at each end thereof by the refrigerant supply header and the evaporating tube respectively. As a result, the spiral capillary tube has a small resistance against the vibration of the evaporator.

SUMMARY OF THE INVENTION

An object of the present invention is to provide a capillary at the entrance of an evaporating tube without using a fine tube.

Another object of the present is to provide a capillary which is easy to produce and is suitable for a mass production.

Further object of the present invention is to provide a capillary which has a large resistance against the vibration of the evaporator.

Further objects and advantages of the present invention will be apparent from a reading of the following detailed description of the preferred embodiments taken in conjunction with the accompanying drawings.

DETAILED DESCRIPTION OF THE PREFERRED EMBODIMENT

Figure 1:
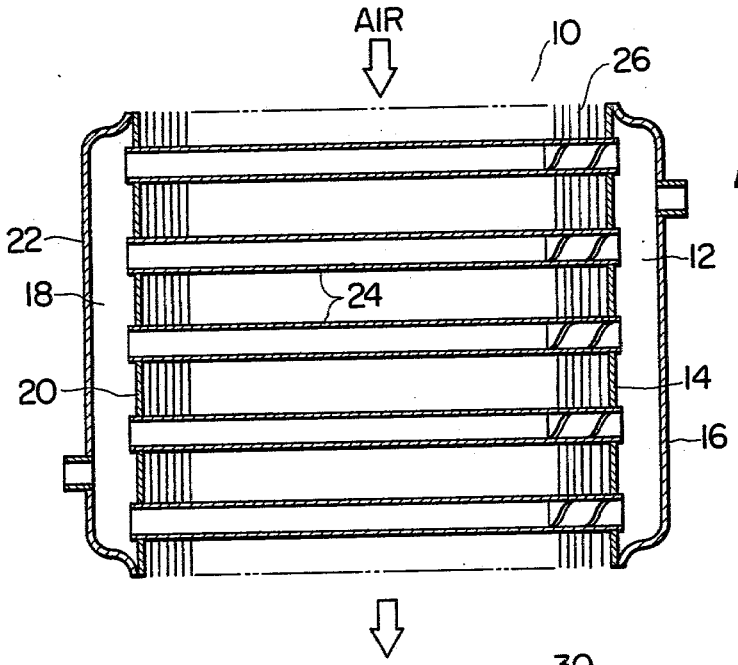
FIG. 1 is a sectional view illustrating an evaporator according to the present invention.

FIG. 1 shows an evaporator 10 of the present invention. A refrigerant supply header 12 is formed by an end plate 14 and a cover plate 16. A refrigerant collector 18 is formed by an end plate and a cover plate 22. A plurality of evaporating tubes 24 open in the refrigerant supply header 12 and the refrigerant collector 18. A plurality of fins 26 are arranged in parallel between two end plates 14 and 20 and are fixed to the evaporating tubes 24.

Figure 2:
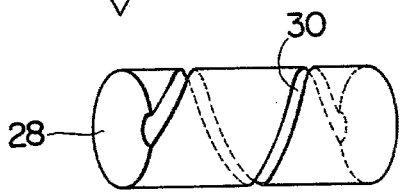
FIG. 2 is a perspective view illustrating a columnar member tightly inserted in a evaporating tube of the evaporator, the columnar member having a spiral groove as a capillary on the outer surface thereof.

Columnar membes 28 are tightly inserted in the evaporating tubes at their respective inlet. The diameter of the columnar member 28 is substantially equal to the inner diameter of the evaporating tube 24. A spiral groove 30 is engraved on the surface of the columnar member 28 as shown in FIG. 2. All spiral grooves 30 are the same in their diameter and length.

The columnar member 28 is coated with copper layer on the whole surface except in the spiral groove 30. The coated columnar member 28 is heated after an insertion of the member 28 into the evaporating tube 24. The copper layer melts and seals between the inner surface of the evaporating tube 24 and the outer surface of the columnar member 28.

The spiral groove 30 serves as a capillary. The refrigerant is expanded when it is gushed out from the spiral groove 30 into the evaporating tube 24.

In such a way, a capillary is formed through the insertion of the columnar member 28 with a spiral groove 30 on it's surface into the evaporating tube 24. Accordingly, the spiral capillary is easy to form and is suitable for a mass production and furthermore has a large resistance against the vibration of the evaporator 10 as compared with that formed by the fine spiral tube.

In such an evaporator 10 as described above, refrigerant flows as follows. Liquid refrigerant is fed from a condenser (not shown) into the refrigerant supply header 12 of the evaporator 10. The liquid refrigerant is distributed through the spiral capillary from the refrigerant supply header 12 into each evaporating tube 24. Pressure of the liquid refrigerant reduces while the refrigerant passes in the capillary. Since all the capillaries are the same in their diameter and the length, all the capillaries are also the same in their flow resistance to the liquid refrigerant. Accordingly the liquid refrigerant is uniformly distributed in each evaporating tube 24.

The liquid refrigerant is gushed out from the capillary into the evaporating tube 24. The liquid refrigerant is expanded and is evaporated in the evaporating tube 24. While the refrigerant is evaporated, the refrigerant takes evaporation heat through the evaporating tube 24 and the fins 26 away from air flowing between the fins 26. The fins 26 increases a heat transfer effect between the refrigerant and the air. In this way, the air is cooled.

Gaseous refrigerant in the evaporating tubes 24 is gathered in the refrigerant collector 18. The gaseous refrigerant is discharged from the refrigerant collector 18 of the evaporator 10 to a compressor (not shown).

Figure 3:
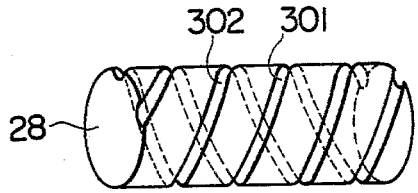
FIG. 3 is a perspective view illustrating another columnar member tightly inserted in a evaporating tube of the evaporator, the columnar member having two spiral grooves as capillaries on the outer surface thereof.

Two spiral grooves 301 and 302 as shown in FIG. 3 to form two capillaries are engraved on the surface of the columnar member 28.

Figure 4:
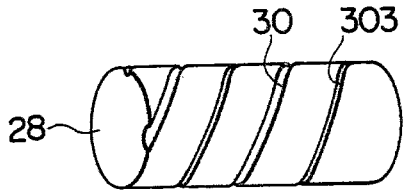
FIG. 4 is a perspective view illustrating a further columnar member tightly inserted in a evaporating tube of the evaporator, the columnar member having a spiral goove as a capillary and having another spiral groove filled with a heat soluble material.

FIG. 4 shows another structure of the columnar member 28, especially the structure for sealing between the outer surface of the columnar member 28 and the inner surface of the evaporating tube 24. Another spiral groove 303 is engraved on the surface of the columnar member 28. The diameter of the spiral groove 303 is smaller than that of the spiral groove 30. The spiral groove 303 is filled with wax. The wax seals between the outer surface of the columnar member 28 and the inner surface of the evaporating tube 24.

What is claimed is:

1. A multi-tube evaporator for a cooler used in an automobile having a refrigerant supply header, a refrigerant collector, a plurality of evaporating tubes connecting said refrigerant supply header and said refrigerant collector, and a plurality of fins associated with evaporating tubes characterized in that a columnar member is tightly inserted in said each evaporating tube at its inlet, the diameter of said columnar member being substantially equal to the inner diameter of said evaporating tube, and capillary means being engraved as a spiral groove on the surface of said columnar member for passing refrigerant from said refrigerant supply header into each evaporating tube by capillary action with a reduction in the pressure of the refrigerant as it passes therethrough, whereby the refigerant is uniformly distributed into the evaporating tubes.

2. The multi-tube evaporator set forth in claim 1, characterized in that a flow resistance of refrigerant is equal in respect to every spiral groove.

3. The multi-tube evaporator set forth in claim 2, characterized in that every spiral groove has the same dimension in its diameter and length.

4. The multi-tube evaporator set forth in claims 1 or 2 or 3, characterized in that the surface of said columnar member, facing to the inner surface of said evaporating tube, is coated by copper.

5. The multi-tube evaporator set forth in claims 1 or 2 or 3, characterized in that another spiral groove filled with a heat soluble material is engraved on the surface of said columnar member.

* * * * *